US005636418A

United States Patent [19]

Vail, III et al.

[11] Patent Number: 5,636,418

[45] Date of Patent: *Jun. 10, 1997

[54] ENVIRONMENTALLY DEGRADABLE URNS FOR BURIAL OF HUMAN CREMATION ASHES IN TERRESTRIAL CEMETERIES

[76] Inventors: William B. Vail, III, 3123 - 198th Pl. SE, Bothell, Wash. 98012; Thomas E. Vail, Jr., 138 Taylor Blvd., Walsenburg, Colo. 81089

[ * ] Notice: The term of this patent shall not extend beyond the expiration date of Pat. No. 5,239,733.

[21] Appl. No.: 114,444

[22] Filed: Aug. 30, 1993

Related U.S. Application Data

[63] Continuation-in-part of Ser. No. 778,493, Oct. 17, 1991, Pat. No. 5,239,733.

[51] Int. Cl.[6] ..... A61G 17/00

[52] U.S. Cl. ..... 27/1

[58] Field of Search ..... 27/1, 2, 35, 4; 47/74; 220/678, 4.21, 4.25, 4.06

[56] References Cited

U.S. PATENT DOCUMENTS

| | | | |
|---|---|---|---|
| 1,495,653 | 5/1924 | Thomas et al. | 220/4.06 X |
| 1,545,036 | 7/1925 | Culhane, Jr. et al. | 220/678 |
| 3,732,602 | 5/1973 | Viah | 27/1 |
| 4,765,501 | 8/1988 | Kao | 220/4.25 X |

*Primary Examiner*—Kien T. Nguyen

[57] ABSTRACT

Articles of manufacture are described called environmentally degradable urns that are also equivalently called temporally degradable urns. Such urns are comprised of chemically and/or biologically and/or physically degradable materials manufactured to provide sealed geometric cavities suitable for the initial deposit of ashes following the cremation of human remains. One-piece castings of environmentally degradable material to hold the cremated remains are also described. Each environmentally degradable urn is designed to degrade within a predetermined period of time following burial in a particular terrestrial location in the earth. Terrestrial cemeteries comprised of one or more environmentally degradable urns placed into the earth are described. Methods of operation of cemeteries for such environmentally degradable urns are described which prescribe as little initial ecological disturbance as possible. After the predetermined period of time, the buried urns completely chemically and/or biologically and/or physically disintegrate, therefore returning the land its previous ecological condition. Thereafter, that land to becomes suitable for the preservation of flora and fauna. Such methods of operation of urn cemeteries can be used as the critical methodology for the routine and ongoing preservation of entire ecosystems.

2 Claims, 6 Drawing Sheets

ENVIRONMENTALLY DEGRADABLE URNS FOR BURIAL OF HUMAN CREMATION ASHES IN TERRESTRIAL CEMETERIES

Application herein is a Continuation-in-Part Application of an earlier application Ser. No. 07/778,493 that is entitled "Temporally Degradable Urns for Burial of Human Creamation Ashes in Cemeteries" having Filing Date of Oct. 17, 1991 that shall issue as U.S. Pat. No. 5,239,733 on Aug. 31, 1993 in the names of the inventors William Banning Vail III and Thomas E. Vail, Jr.

BACKGROUND OF THE INVENTION

1. Field of the Invention

The Field of Invention relates to an article of manufacture that is an urn that is used for the containment of human cremation ashes which is buried into the earth that is designed to disintegrate within prescribed periods of time in the particular location of earth chosen. Such an article of manufacture is defined as a temporally degradable urn that is also defined as an environmentally degradable urn. The Field of Invention further relates to a composition of matter comprised of one or more temporally degradable urns placed into the earth to form a cemetery wherein said temporally degradable urns are designed to disintegrate within prescribed periods of time within that particular cemetery. The Field of Invention further relates to a new use of said composition of matter that becomes a wildlife preserve after the urns within the particular cemetery have completely disintegrated in time. Applicable sections of U.S. Patent Classification include Class 27, Subclasses 1 and 2.

2. Description of the Prior Art

Application Ser. No. 07/778,493 that is entitled "Temporally Degradable Urns for Burial of Human Cremation Ashes in Cemeteries" having Filing Date of Nov. 17, 1991 shall issue as U.S. Pat. No. 5,239,733 on Aug. 31, 1993 in the names of the inventors William Banning Vail III and Thomas E. Vail, Jr. That Application has only one figure (FIG. 1) that explicitly shows a semi-ellipsoidal cavity in a temporally degradable urn. The Claims allowed in Ser. No. 07/778,493 specifically reference semi-ellipsoidal cavities. The inventors wish to point out that temporally degradable urns may be designed to have many different geometric shaped cavities, including rectangular shapes, cylindrical shapes, and may in fact have any geometric shape resulting an enclosed or sealed cavity. Similarly, the exterior of the urns may have variable geometric shapes including rectangular shapes, cylindrical shapes, etc. Therefore, the application herein describes temporally degradable urns that are defined equivalently as environmentally degradable urns that have different geometric shapes. These differently shaped environmentally degradable urns disintegrate within terrestrial cemeteries within specific time periods depending on the location. The inventors for the application herein are the same as for Ser. No. 07/778,493.

The inventors are aware of only one other relevant prior art reference that is U.S. Pat. No. 3,732,602 entitled "Submersible Crematory Urn" that was Filed on May 28, 1971 and that issued on May 15, 1973. The submersible urn therein described is designed of degradable material whereby the chemical action of the water in which it is submerged dissolves it over a period of time. However, the submersible urn is not intended for use in terrestrial environments and therefore does not describe the invention herein. The submersible urn described in U.S. Pat. No. 3,732,602 is not intended for burial into the earth, is not designed to disintegrate within prescribed periods of time in the particular location of earth chosen, and therefore does not describe the invention herein. The submersible urn described in U.S. Pat. No. 3,732,602 does not describe a composition of matter comprised of one or more temporally degradable urns placed into any chosen portion of the earth to form a terrestrial cemetery wherein said temporally degradable urns are designed to disintegrate within prescribed periods of time within that particular cemetery and therefore does not describe the invention herein. The submersible urn described in U.S. Pat. No. 3,732,602 does not describe a new use of said composition of matter which becomes a wildlife preserve after the urns within the particular chosen terrestrial cemetery have completely disintegrated in time. Therefore, U.S. Pat. No. 3,732,602 does not anticipate the invention herein.

SUMMARY OF THE INVENTION

This application concerns solving two seeming disparate problems. Finding adequate terrestrial cemetery space in the United States is becoming progressively more difficult and costly in time. As another seemingly independent problem, preserving land indefinitely for ecological preserves for flora and fauna, is also becoming progressively more difficult and costly in time. Articles of manufacture, compositions of matter, and uses for the compositions are disclosed herein which allow using predetermined portions of land for the above two different purposes. Initially, the predetermined portions of land are operated as cemeteries. After some predetermined period of time, the predetermined portions of land become used exclusively and solely as wildlife preserves.

Articles of manufacture are described which are chemically degradable and/or biologically degradable and/or physically degradable urns for the initial deposit of ashes following the cremation of human remains. For the purposes herein, the term "environmentally degradable" shall be defined to refer to any and all conceivable mechanisms for the disintegration of the urns within the earth including chemical decomposition, and/or biological decomposition, and/or physical decomposition, and/or any natural decomposition mechanism, and/or any other type of decomposition mechanism, related in any way to the eventual disintegration of an urn within the earth. The term "environmentally degradable" may be conveniently abbreviated herein by the term "degradable". The articles of manufacture may have many different chosen geometric shapes provided that the shapes chosen result in "sealed geometric cavities" suitable for the reception of human cremation ashes. The sealed geometric cavities are designed to surround or encapsulate the human cremation ashes. These articles of manufacture are designed to degrade, or disintegrate, within a predetermined period of time following burial in the earth. An urn that degrades or disintegrates within a predetermined period of time shall be defined herein as a "temporally degradable urn" or as an "environmentally degradable urn". Methods of operation of cemeteries for such temporally degradable urns are described which prescribe as little initial ecological disturbance as possible. After the predetermined period of time, the buried urns completely chemically and/or biologically and/or physically disintegrate, therefore returning the land to its previous ecological condition. Thereafter, that land becomes suitable for the preservation of flora and fauna.

Accordingly, an object of the invention is to provide new articles of manufacture that are urns having different types of geometric cavities that are used to encapsulate ashes following human cremations which upon placement into the earth decompose in predetermined and predictable periods of time within particular localities that are defined to be temporally degradable urns and that are also defined to be environmentally degradable urns.

Another object of the invention is to provide a composition of matter comprised of one or more environmentally degradable urns placed into the earth to form a terrestrial cemetery wherein said environmentally degradable urns are designed to disintegrate within prescribed periods of time within that particular cemetery.

It is yet another object of the invention to provide new uses of the new compositions of matter which become wildlife preserves after the urns within the terrestrial cemeteries have completely disintegrated in time.

DESCRIPTION OF THE PREFERRED EMBODIMENTS

Figure 1:
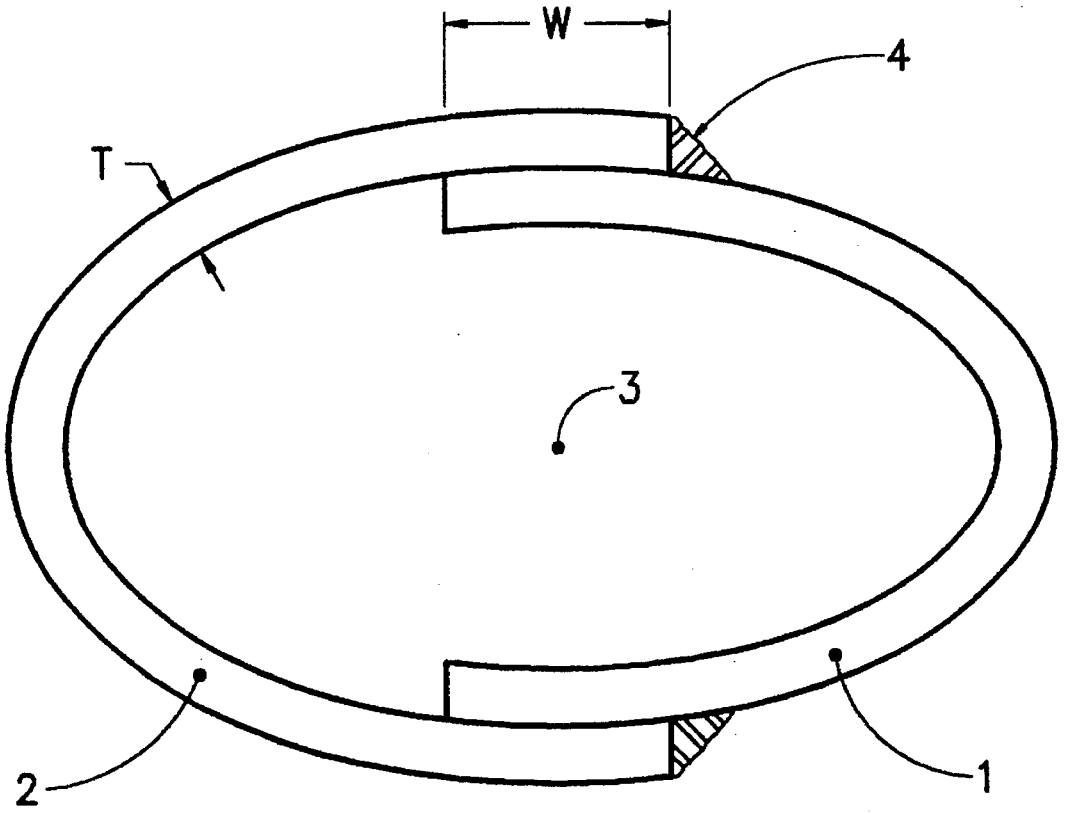
FIG. 1 describes an article of manufacture defined as a temporally degradable urn, or environmentally degradable urn, having a semi-ellipsoidal geometric cavity for burial of human cremation ashes in cemeteries.

FIG. 1 is a section view of one preferred embodiment of an article of manufacture of the invention. One-half of an ellipsoidal cavity of revolution 1 is designed to slide into an interior portion of another one-half ellipsoidal cavity of revolution 2 as shown in FIG. 1. The cavities overlap by width W. The wall thickness is T, being the same for both cavities. The material comprising the wall thickness T is chemically and/or biologically and/or physically degradable in a predetermined period of time in a given cemetery location. The material is also called an environmentally degradable material. The cavity volume 3 is to be filled with ashes from human cremation prior to the joining of the two ellipsoidal cavities of revolution. Joining material 4 mechanically joins the two ellipsoidal cavities of revolution thereby forming a sealed geometric cavity suitable for burial in the cemetery for the temporally degradable urns. FIG. 1 describes an article of manufacture that provides a sealed geometric cavity made from environmentally degradable material that is suitable for the reception of human cremation ashes for terrestrial burial.

In a preferred embodiment, the ellipsoidal cavities are made from iron. In this case, the joining material would be conveniently a weld, which may be waterproof. In a particular cemetery having a certain average rainfall, a certain average temperature, and known soil chemistry, a particular wall thickness T can be chosen to degrade in a particular time. For example, in a particular location within the state of Colorado, weather conditions might provide for the total disintegration of a wall thickness of 0.030 inches thick of iron, and the associated weld, within the following time period: no sooner than 60 years (TS) and no later than 100 years (TL), with the average expected decomposition time being 80 years (TA).

Following burial, in general the urn will not decompose sooner than a time TS, nor later than a time TL, with the average decomposition time being defined as TA. Analysis from the field of chemical engineering will determine these times for a particular cemetery location using knowledge of at least the following: the typical weather conditions providing average moisture present in the soil and the average soil temperature; detailed chemical analysis of the soil; and experiments on the decomposition of materials at specific localities. Experience in given localities will also serve as a guide for determining the above time intervals.

The urns may be made of different materials, different thicknesses, and different joining materials. For example, in another preferred embodiment, the urns may be fabricated from compressed wood which would biodegrade within predetermined period of time. In such a preferred embodiment, biodegradable glue would be used as the joining material. Virtually any material may be used that is environmentally degradable and that can be formed into a geometric object having a sealed cavity for the receipt cremation ashes. The urns may also be used to encapsulate the ashes from beloved pets which is a minor variation of the invention.

Figure 2:
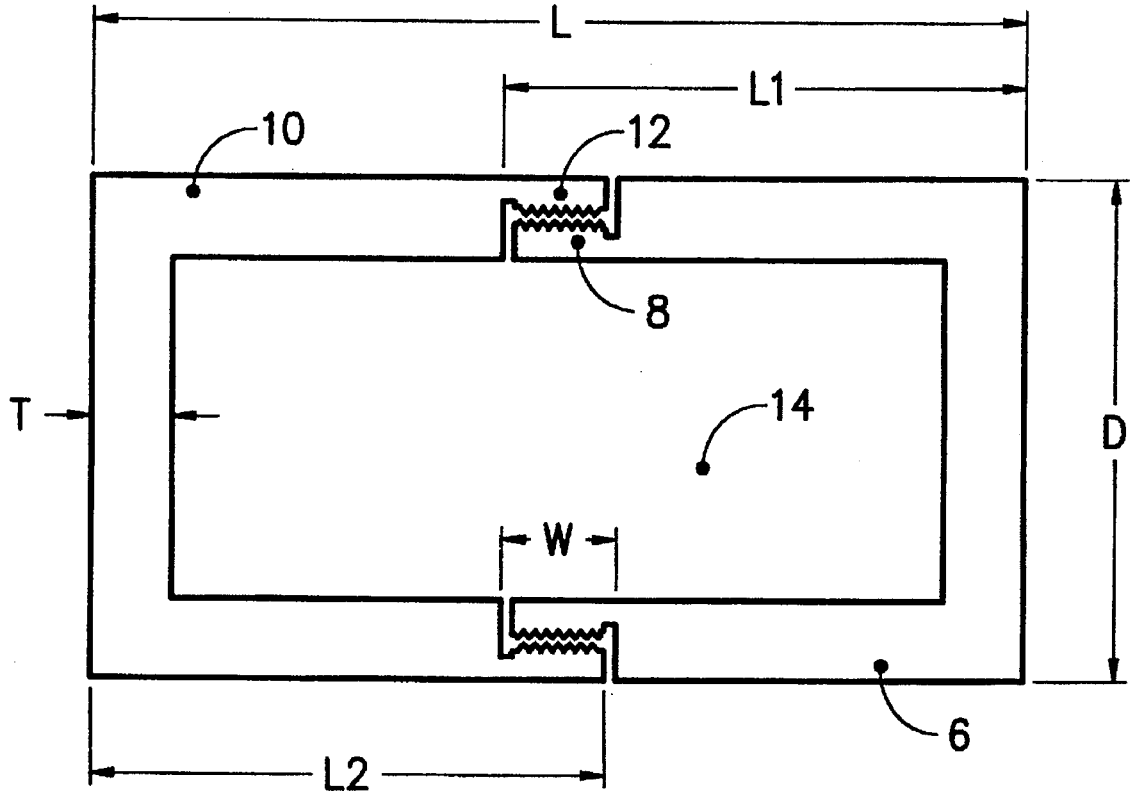
FIG. 2 describes an environmentally degradable urn having a cylindrical geometric cavity for the burial of human cremation ashes in cemeteries.

FIG. 2 is a section view of another preferred embodiment of an article of manufacture of the invention. FIG. 2 shows an environmentally degradable urn having a cylindrical cavity for burial of human cremation ashes in cemeteries. First right circular cylinder 6 having an outside diameter of D and a length of L1 has a first threaded end 8. Second right circular cylinder 10 having an outside diameter of D and a length of L2 has a second threaded end 12. First threaded end 8 and second threaded end 12 are designed so that the threads engage one another when threaded together over the width W forming a sealed geometric cavity 14 for the receipt of cremation ashes. The overall length of the assembled cylindrical urn is the length L. The wall thicknesses of right circular cylinders 6 and 10 are T except in the respective threaded ends respectively 8 and 12. The wall material may be made of any environmentally degradable material including iron, pressed wood fiber, wood, recycled paper, etc. Any type of naturally degradable compound may be used to lubricate the threads including grease, lard, etc.

Figure 3:
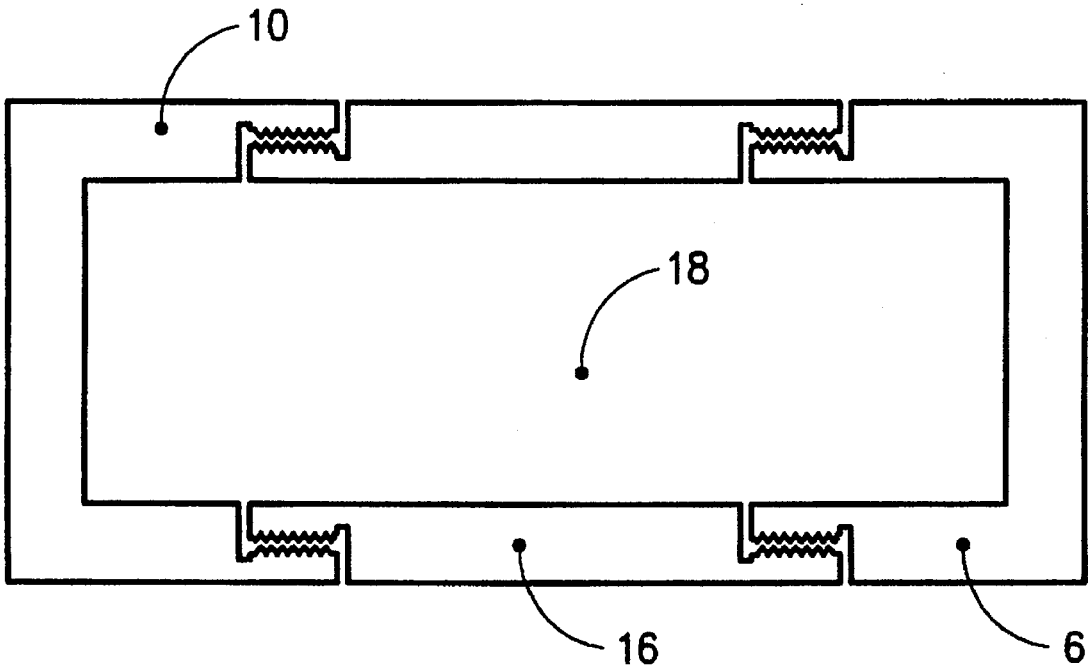
FIG. 3 describes an environmentally degradable urn having a cylindrical cavity fabricated from three different pieces.

The sectional view of another preferred embodiment of the invention is shown in FIG. 3 that is closely related to the embodiment shown in FIG. 2. In FIG. 3, first right circular cylinder 6 and second right circular cylinder 10 are joined together by third mating threaded cylinder 16 assembled as shown in FIG. 3. The resulting sealed cavity is suitable for receiving cremated remains. The materials and wall thickness appropriate for the urn described in FIG. 2 are appropriate for the urn described in FIG. 3. Therefore, an environmentally degradable urn may be comprised of more than two pieces that result in a sealed cavity suitable for receiving cremated remains.

Figure 4:
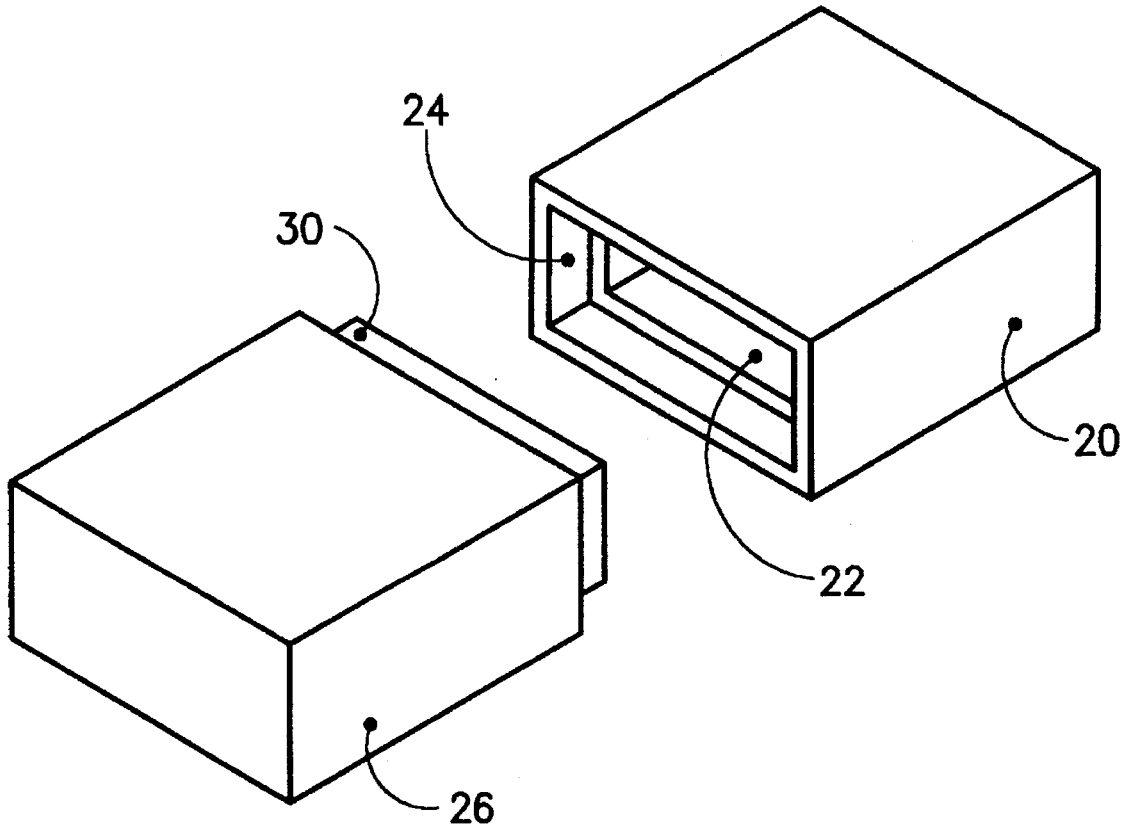
FIG. 4 describes an environmentally degradable urn having a rectangular geometric cavity for the burial of human cremation ashes in cemeteries.

FIG. 4 is a perspective view of another preferred embodiment of an article of manufacture of the invention. FIG. 4 shows an environmentally degradable urn prior to assembly that would, upon assembly, have a sealed rectangular cavity for burial of human cremation ashes in cemeteries. First rectangular enclosure 20 has first rectangular cavity 22 and the rectangular recession Second rectangular enclosure 26 has second rectangular cavity 28 (not shown) and rectangular protrusion 30. The respective rectangular recession 24 and rectangular protrusion 30 are designed to mechanically mate together. After receiving the cremation ashes, the first and second rectangular enclosures 20 and 26 join together by gluing the respective rectangular recession 24 to the rectangular protrusion 30. After so joining, a sealed rectangular geometric cavity has been created to hold the cremated remains. The first and second rectangular enclosures 20 and 26 may be fabricated from any environmentally degradable material including iron, pressed wood fiber, wood, recycled paper, etc. The glue to be used must be naturally degradable and must environmentally degrade at the same time, or before, the walls of the rectangular cavities disintegrate in the particular location chosen.

Figure 5:
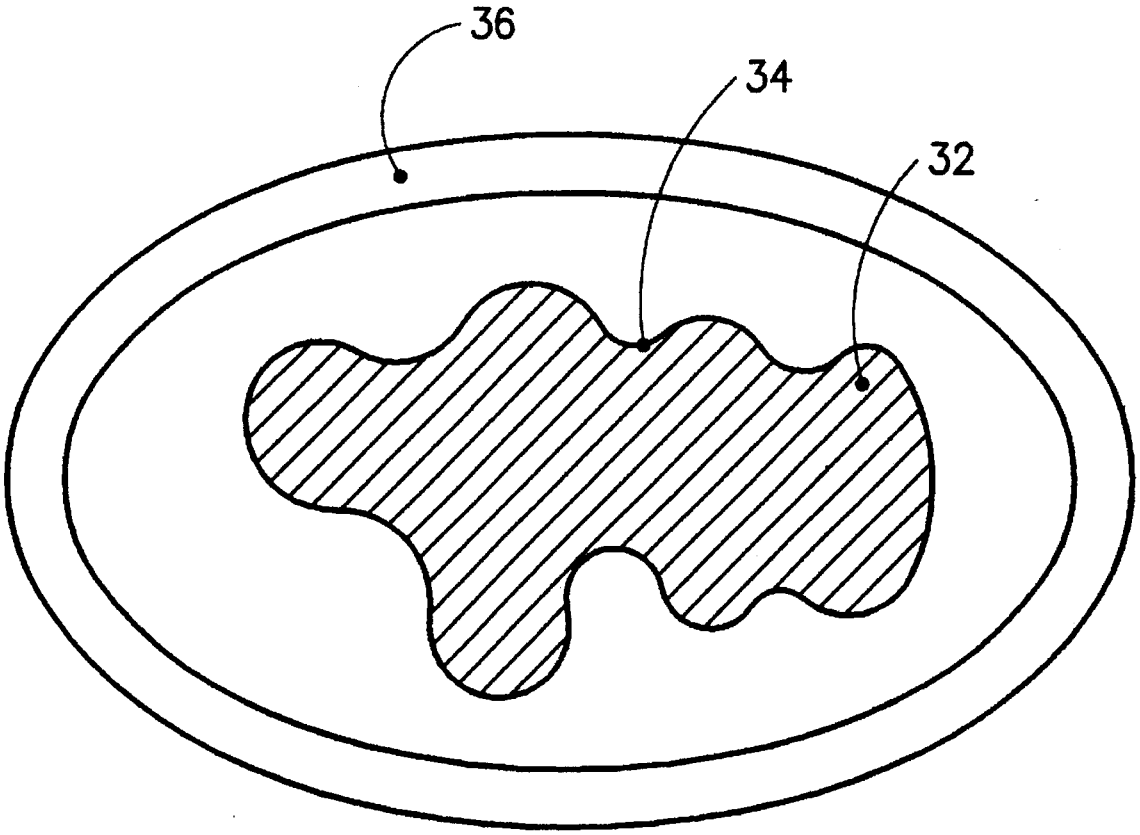
FIG. 5 describes an environmentally degradable urn having a one-piece cast elliptical cavity for the burial of human cremation ashes in cemeteries.

FIG. 5 is a section view of another preferred embodiment of an article of manufacture of the invention. FIG. 5 describes an environmentally degradable urn having a one-piece cast elliptical cavity for the burial of human cremation ashes in cemeteries. Cremated remains 32 are contained in a thin, degradable bag 34, such as a waxed paper bag. Using techniques standard in the casting industry, a solid ellipsoidally shaped material 36 is cast in one-piece around the degradable bag. The degradable bag must contain the cremated remains during the casing process. The casted material may be a mix of degradable glue and wood fiber as an example. The point is that the environmentally degradable urn may be fabricated as a one-piece casted article of manufacture. Additionally, the one-piece casted urn may have more than just one sealed cavity that may contain any portion of the cremated remains although such an embodiment is a minor variation of the invention herein. Such an urn could be called a "multi-cavity" urn.

Figure 6:
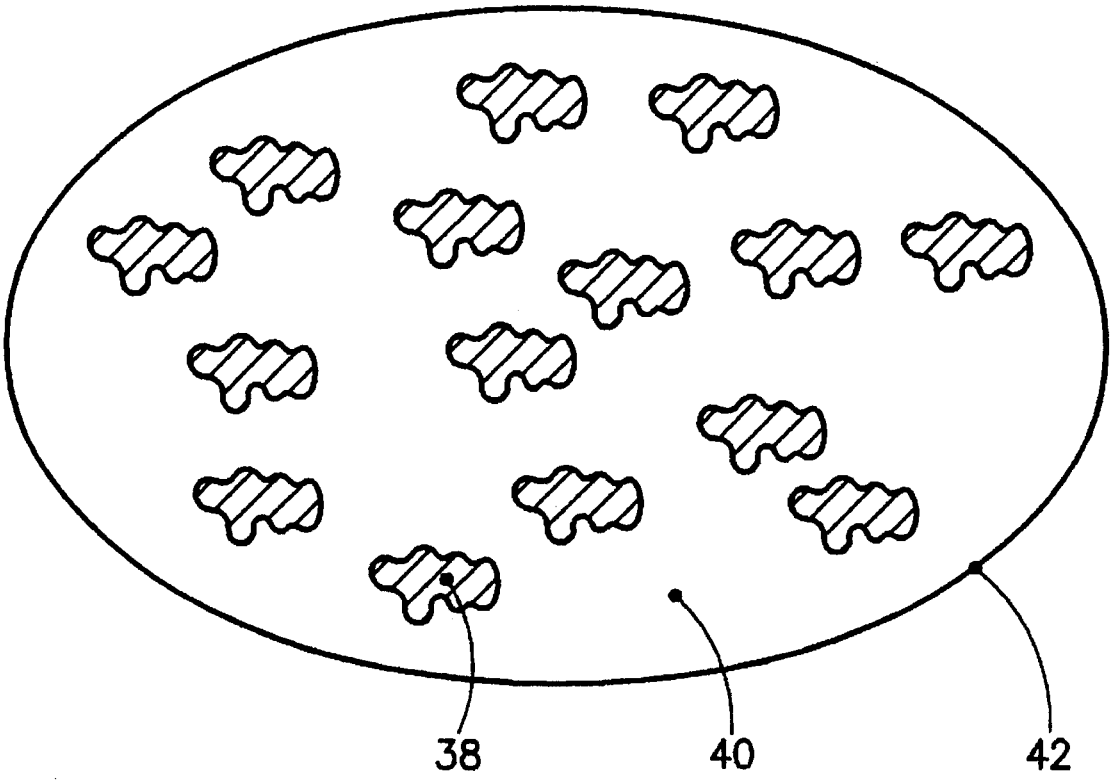
FIG. 6 describes an environmentally degradable urn having a one-piece cast elliptical solid interior for the burial of human cremation ashes in cemeteries.

FIG. 6 is a section view of another preferred embodiment of an article of manufacture of the invention. FIG. 6 describes an environmentally degradable urn having a one-piece cast elliptical solid interior for the burial of human cremation ashes in cemeteries. In FIG. 6, cremated remains 38 are cast in a solid environmentally degradable material 40 resulting in a solid elliptical urn 42. The exterior portion of the solid elliptical urn 42 could be supplied with a thin protective layer that is environmentally degradable although this is a minor variation of the invention herein. This solid elliptical urn is an example of means to bury cremated remains in the earth that is environmentally degradable.

Therefore, articles of manufacture called environmentally degradable urns, or temporally degradable urns, have been described which are urns which disintegrate due to any mechanism in predetermined time periods within particular terrestrial cemeteries. The articles of manufacture described have many different chosen geometric shapes resulting in the provision of articles having sealed geometric cavities suitable for the reception of human cremation ashes. The sealed geometric cavities surround or encapsulate the human cremation ashes until the urn walls naturally disintegrate within the earth.

One or more of such temporally degradable urns can be placed into the earth at any one location to form a cemetery wherein said temporally degradable urns are designed to disintegrate within prescribed periods of time within that particular cemetery. The fact that the urns disintegrate within prescribed periods of time provides a composition of matter (the terrestrial cemetery) that returns to its natural state within those prescribed periods of time. The invention further provides uses of the compositions of matter which become wildlife preserves after the urns within the cemeteries have completely disintegrated in time. The definition of "completely disintegrated in time" is subject to standard statistical analysis of the type typically used in the engineering and measurement arts. Methods of operation of the cemeteries for such urns, including methods of business operation of such cemeteries, are now described which allow the cemeteries to be used for the preservation of flora, fauna, and of ecological systems.

Cemeteries exist partially because of the requirements of the living relatives and acquaintances. Such people have a need to visit the marked gravesite of the deceased.

Typically, there is such a need for a predetermined period of time, perhaps 80 years. In such a case, the cremation ashes would be interred in an urn which decomposes within a particular predetermined cemetery within an average time TA of 80 years. During an initial period of operation, the urn cemetery could be operated on either a non-profit basis or as a for-profit cemetery. Thereafter, following the disintegration of the urns, the cemetery would automatically convert into ecological preserves for wildlife.

A particular hypothetical example is recited below which describes certain temporally degradable urns, certain methods of operation of the cemeteries for the urns, and certain methods of business operations which provide for conversion of the urn cemeteries into ecological preserves after the particular time period of 100 years.

The location for the urn cemetery in this example is currently privately held land near the San Isabel National Forest adjacent to a proposed wilderness area. This land is now in a wild-state, and is worth preserving indefinitely into the future for the varied wildlife, plant life, and for its ecological significance in general. This land would be purchased from its current owners by a corporate entity, and such land to be preserved is an example of an "Ecological Trust Property". This particular Ecological Trust Property also has an ideal mountain view that would be desirable as an urn cemetery location. The Ecological Trust Property would be operated as a normal cemetery for approximately 100 years.

Each urn would be buried in a given gravesite on a minimum of 1 acre plots in the Ecological Trust Property. Here, there is to be 1 acre per each gravesite. Each gravesite is to be plotted in detail on a map for location by relatives during the first 100 years. An environmentally degradable urn is to be buried in each gravesite with as little disturbance to the surrounding ecology as possible. Each gravesite is to be marked solely with a 12 inch by 12 inch marker headstone that is flush with the earth. It is anticipated that the entire cemetery, or this particular Ecological Trust Property, would become filled within 20 years. All urns would disintegrate within 80 years. At the end of 100 years, all the marker-head stones would be collected into a very small portion on the Ecological Trust Property for future historical records.

After a total time span of 100 years, the particular Ecological Trust Property would be formally transferred to the Ecological Trust Foundation. By that time, the land would show absolutely no signs of having been used as an urn cemetery. The sole purpose of the Ecological Trust Foundation is to preserve the natural states and ecological significance of the various Ecological Trust Properties donated or otherwise transferred to that foundation over time. Of course, a major purpose for the temporally degradable urn is so that the land would return to its wild state after the disintegration of the urn itself. After the decomposition of the urn, the land becomes suitable for ecological preservation.

Ideally, it is hoped that the land can be permanently designated for ecological preservation following one "cycle" as an urn cemetery. However, if the financial burden of property taxation, or other types of taxation or operational costs prove by experience to be too great, then the land could be essentially repetitively "leased" every 100 years in this example to successive generations of individuals so as to financially guarantee that the land designated as an urn cemetery is forever basically used for ecological preservation.

The decomposition of such urns may also be of importance in the legal field which would allow the legal conversion of the urn cemeteries into wildlife preserves. Such conversion of urn cemeteries into wildlife preserves may also involve the initial explicit written permission of those individuals to be interred into the urn cemeteries.

The invention provides a new composition of matter comprised of the combination of environmentally degradable urns containing cremated human ashes and their burial on land initially used as a terrestrial urn cemetery that is to be ecologically preserved into the future. This new composition of matter provides the new and surprising result of allowing the preservation of ecologically significant lands into the future.

The environmentally degradable urns and the cemeteries disclosed herein satisfy the needs of human burial services which also have the surprising potential to preserve large portions of ecosystems indefinitely into the future. By paying for burial in an Ecological Trust Property, the individual creates a living legacy into the future not achievable by other methods. For example, by purchasing a given property, an individual cannot guarantee burial on it, nor can an individual guarantee that such land will not change hands for other uses. The temporally degradable urns, and the method of burial of the urns in such an Ecological Trust Property does provide a guarantee to an individual of such a living legacy of ecologically preserved land into the future. In this particular manner, an individual's death may in fact provide an eternal living legacy into the future.

What is claimed is:

1. A method of making a degradable urn for the terrestrial burial of cremated remains comprising the steps of:

choosing a particular terrestrial location for the burial of the degradable urn within the soil present at said particular terrestrial location;

choosing a predetermined maximum duration of time for the disintegration of said urn following the burial of the degradable urn within the soil present at said particular terrestrial location;

determining at least the average rainfall and soil chemistry conditions in said particular terrestrial location;

choosing a material for the fabrication of said urn that shall eventually disintegrate following burial within the soil present in said particular terrestrial location under said average rainfall and soil chemistry conditions;

determining the particular thickness of the material that shall disintegrate within said predetermined maximum duration of time after it is buried within the soil present at said particular terrestrial location.

2. A method of using a degradable urn for the terrestrial burial of cremated remains comprising the steps of:

choosing a particular terrestrial location for the burial of the degradable urn within the soil present at said particular terrestrial location;

choosing a predetermined maximum duration of time for the disintegration of said urn following the burial of the degradable urn within the soil present at said particular terrestrial location;

determining at least the average rainfall and soil chemistry conditions in said particular terrestrial location;

encapsulating the cremated remains within means having a sealed geometric cavity surrounded by said particular thickness of material to make a degradable urn that shall degrade within said predetermined maximum duration of time within the soil present at said particular terrestrial location;

placing a plurality of degradable urns into the soil at said particular terrestrial location;

allowing the degradable urns to disintegrate over said predetermined maximum duration of time and then converting said tract of land into an ecologically viable tract such as a wildlife refuge park.

* * * * *